US007097065B2

(12) United States Patent
Yoneoka et al.

(10) Patent No.: US 7,097,065 B2
(45) Date of Patent: Aug. 29, 2006

(54) BEVERAGE CONTAINER WITH STRAW

(75) Inventors: Sumiyo Yoneoka, Saitama (JP); Kazunao Ogura, Saitama (JP); Momoe Kigushi, Saitama (JP)

(73) Assignee: Combi Corporation, Tokyo (JP)

( * ) Notice: Subject to any disclaimer, the term of this patent is extended or adjusted under 35 U.S.C. 154(b) by 0 days.

(21) Appl. No.: 10/131,397

(22) Filed: Apr. 25, 2002

(65) Prior Publication Data

US 2002/0158069 A1 Oct. 31, 2002

(30) Foreign Application Priority Data

Apr. 25, 2001 (JP) ..... 2001-127695
Apr. 25, 2001 (JP) ..... 2001-127722

(51) Int. Cl.
*B65D 51/16* (2006.01)
*A47G 19/22* (2006.01)

(52) U.S. Cl. ..... 220/709; 220/254.3; 220/203.06; 220/203.07; 220/360; 220/367.1; 220/710.5; 222/529; 222/530

(58) Field of Classification Search ..... 220/710.5, 220/745, 203.05–203.07, 203.19, 203.22, 220/231, 252, 259.2, 259.3, 360, 361, 367.1, 220/373, 705, 708, 714, 725, 726, 728, 826, 220/254.2, 254.3, 254.8, 709; 222/527, 529, 222/530; 239/29.3, 33
See application file for complete search history.

(56) References Cited

U.S. PATENT DOCUMENTS 3,021,991 A 2/1962 Cohen et al.
4,448,316 A * 5/1984 Hiroshige ..... 215/388
4,925,040 A * 5/1990 Wang ..... 215/388
5,150,815 A * 9/1992 Saklad ..... 220/708
5,203,468 A * 4/1993 Hsu ..... 220/254.3
5,273,172 A * 12/1993 Rossbach et al. ..... 215/229
5,282,541 A * 2/1994 Chen ..... 215/229
5,337,918 A * 8/1994 Wang ..... 220/708
5,346,081 A * 9/1994 Lin ..... 215/229
5,361,934 A * 11/1994 Spence, Jr. ..... 220/707
5,462,194 A 10/1995 Barnwell
5,465,866 A * 11/1995 Belcastro ..... 220/709
5,497,901 A * 3/1996 Chen ..... 220/708
5,579,948 A * 12/1996 Lin ..... 220/707
5,582,320 A * 12/1996 Lin ..... 220/708
5,897,013 A * 4/1999 Manganiello ..... 220/709
5,908,126 A * 6/1999 Wang ..... 215/229
6,050,433 A * 4/2000 Russell et al. ..... 215/229
6,196,413 B1 * 3/2001 Tung ..... 220/709
6,279,773 B1 * 8/2001 Kiyota ..... 220/709
6,523,711 B1 * 2/2003 Hughes et al. ..... 220/709
6,609,624 B1 * 8/2003 Goto et al. ..... 220/259.1

FOREIGN PATENT DOCUMENTS

CN 95221770.8 6/1996
DE 196 46 261 A1 3/1998
EP 0881155 A 12/1998
JP 02283309 A * 11/1990
JP 2001002106 A * 1/2001
JP 2001039464 A * 2/2001
JP 2000 335616 A 4/2001

* cited by examiner

*Primary Examiner*—Stephen K. Cronin
*Assistant Examiner*—James N. Smalley
(74) *Attorney, Agent, or Firm*—Birch, Stewart, Kolasch & Birch, LLP

(57) ABSTRACT

A straw adapter 2 is removably disposed in the opening of a beverage container 1, and a straw 22 is attached to the straw adapter 2. A straw cap 12 is mounted on the straw adapter 2, for covering the straw attached to the straw adapter 2. Operations of the straw cap 12 opens and closes an air hole opening/closing valve 6.

10 Claims, 7 Drawing Sheets

BEVERAGE CONTAINER WITH STRAW

BACKGROUND OF THE INVENTION

1. Field of the Invention

The present invention relates to a beverage container with a straw, which has the straw kept inserted in the container so as to be always ready for drinking, as required, a beverage held in the container with the straw.

2. Description of the Prior Art

Beverage containers with straws having the straws kept inserted in the containers so as to facilitate infants, etc. drinking any time beverages held in the containers were proposed and have been generally and practically used. In such containers with straws, especially when hot liquids are held in the containers, the heat of the hot liquids often causes the hot liquids to jet through the straws upon opening the straw caps covering the straws. Air hole opening/closing valves are provided in the container bodies or the straw caps so that the air hole opening/closing vales are opened before use to thereby release the pressures for the prevention of the unexpected jets of the hot liquids, etc.

In the containers with straws, marks, e.g., "open" and "close" respectively indicating the opened air holes and the closed air holes are provided. However, in use, the confusion as to which state of the "open" and "close" the valve is in takes place, or the operation of the valve is missed. Resultantly, steam often jets out. This is a disadvantage.

For mounting the straws, straw adapters are thread-engaged with the openings of the container bodies, and the straws are inserted in the straw adapters. When the adapters are fastened, it is not easily seen to which position the adapters are fastened for the prevention of the leakage. As anti-slip means in fastening the adapters, small projections are merely provided on the side surfaces, which makes it hard to fasten the adapters to a position where the adapters do not have the leakage. This is also a disadvantage.

Handles with which the container bodies are held by the hands are attached to the container bodies. However, the handles are vertically oriented, which makes it difficult for infants, who are not yet good at turning the wrists and other motions, to hold the containers by themselves to drink beverages held in the containers.

Furthermore, the straws are required to have a suitable length and not to disengaged.

SUMMARY OF THE INVENTION

In consideration of the above-described disadvantages, an object of the present invention is to provide a beverage container with a straw which requires no intentional operation of the pressure release. Another object of the present invention is to provide a beverage container with a straw which easily fastens the straw adapter to a position where the leakage does not take place, permits infants to smoothly drink beverages held in the containers, and can retain a suitable length of the straw.

One or more of these and other objects are A beverage container comprising: a container body having an opening; straw adapter engaged with the opening of the container body and for holding a straw in a straw hole; a straw cap being disposed on the straw adapter for covering the straw hole, wherein the straw adapter further includes the straw operatively engaged with said straw hole, an air hole, an air hole opening and closing valve being disposed on a distal end of the straw cap so as to cooperate with the straw cap for opening and closing the air hole, and a rotatable locking member being provided on the straw adapter for retaining the straw cap in an opened state or a closed state and said air hole in an opened state or a closed state, wherein the air hole opening and closing valve is operatively secured to the locking member.

One or more of these and other objects is accomplished by a beverage container comprising a container body having an opening; a straw adapter engaged with the opening of the container body and for holding a straw in a straw hole; a straw cap being disposed on the straw adapter for covering the straw hole, wherein the straw adapter further includes the straw operatively engaged with said straw hole, an air hole, a pair of raised ribs extending substantially parallel along an upper surface of the straw adapter, and an air hole opening and closing valve being formed of an elastic material and being disposed on the straw cap so as to cooperate with the straw cap for opening and closing the air hole, wherein the air hole opening and closing valve is secured to a swing pin of the straw cap held between the ribs, and is operatively hinged together with the straw cap to said swing pin.

According to the present invention, a beverage container with a straw comprises a container body having an opening; and a straw adapter engaged with the opening of the container body and holding a straw.

According to the present invention, a straw cap is swingably disposed on the straw cap, for covering the straw, and the straw adapter includes an air hole, and an air hole opening/closing valve disposed on the distal end of the straw cap so as to cooperate with the straw cap for opening and closing the air hole.

According to the present invention, a lock member is provided on the straw adapter, for retaining the straw cap in an opening state or a closing state, and the air hole opening/closing valve is secured to the lock member.

According to the present invention, the straw adapter includes a cylindrical casing, and the air hole is formed in the valve casing, and the air hole opening/closing valve comprises a valve body rotatably disposed in the valve casing.

According to the present invention, a communication passage is provided on the outside surface of the valve body, for communicating the air holes with the atmosphere.

According to the present invention, the valve body in the valve casing is rotated by the lock member, which retains the straw cap in an opening state or a closing state.

According to the present invention, the air hole opening/closing valve is secured to a swing pin of the straw cap, and is swung together with the straw cap.

According to the present invention, a straw pusher is swingably disposed on the straw adapter so that the straw pusher is inside the straw cap.

According to the present invention, the straw cap includes a drive projection for swinging the straw pusher in an open direction when the straw cap is opened.

According to the present invention, the straw adapter is thread-engaged in the container body, and positioning projections are provided respectively on the outside surfaces of the straw adapter and the container body, for indicating that the straw adapter is at a prescribed fastening position with respect to the container body.

According to the present invention, knobs are provided on the outside surface of the straw adapter.

According to the present invention, handles are provided on the outside surface of the container body, and the handles extend toward the straw.

According to the present invention, the straw includes a longer straw component positioned inside the container body and a shorter straw component positioned outside the container body, which can be interconnected with each other, and the shorter straw component is secured tot he straw adapter.

According to the present invention, the shorter straw component has one end engaged in a straw hole of the straw adapter, and the distal end of the shorter straw component has an outer flange and an inside collar for securing the shorter straw component to the straw adapter.

According to the present invention, a straw insert hole tilted to the axis of the shorter straw component is provided at the collar, and the longer straw component is inserted into the straw insert hole.

DESCRIPTION OF THE PREFERRED EMBODIMENTS

A first embodiment of the present invention will be explained below with reference to the drawings attached hereto.

Figure 1:
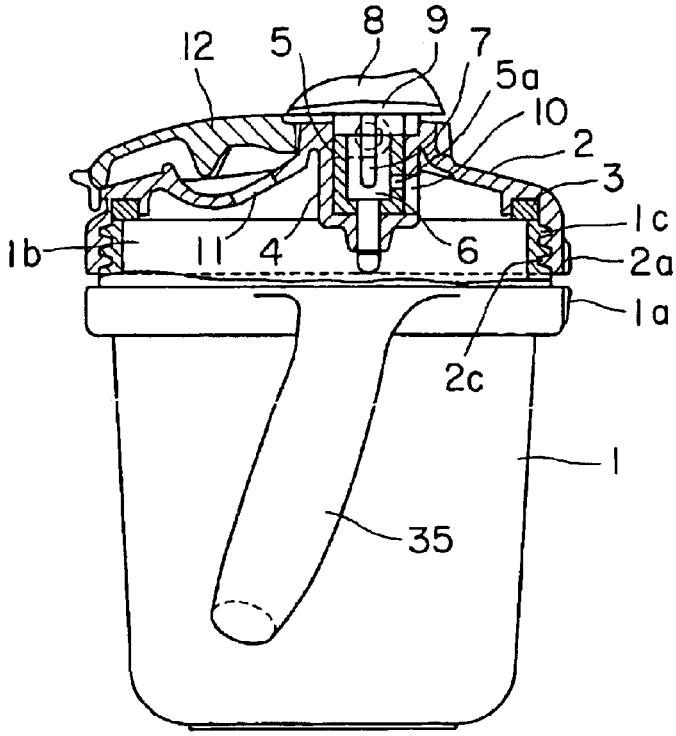
FIG. 1 is a partial sectional view of the beverage container with a straw according to a first embodiment of the present invention.
Figure 2:
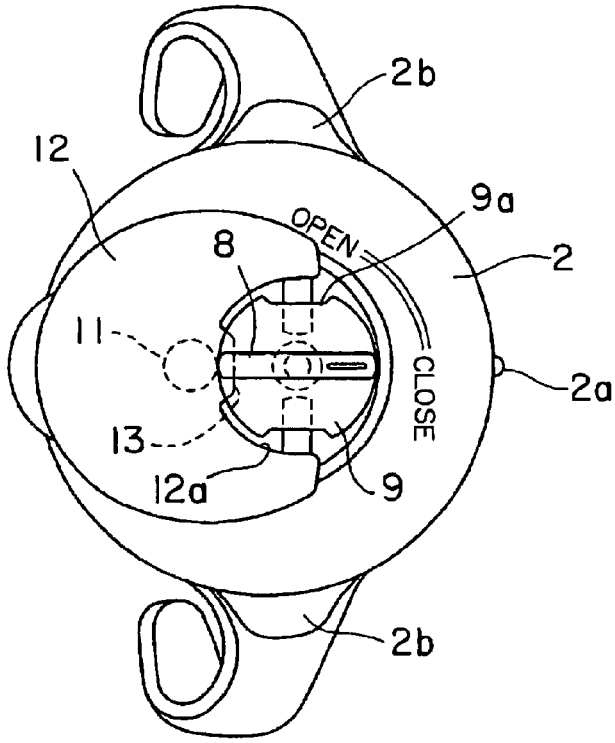
FIG. 2 is a plan view of the beverage container shown in FIG. 1.

FIG. 1 is a partial sectional view of the beverage container with a straw according to the present invention. FIG. 2 is a plan view of the beverage container with a straw according to the present invention. As shown in FIG. 1, the beverage container with a straw comprises a container body 1 having an opening 1*b*, and a straw adapter 2 removably thread-engaged with the opening 1*b* of the container body 1. A packing 3 is disposed circumferentially inside the straw adapter 2 for making a seal between the straw adapter 2 mounted on the container body 1 and the upper end of the container body 1.

Positioning projections 1*a*, 2*a* are provided respectively on the outside surfaces of the container body 1 and the straw adapter 2 at positions where the container body 1 and the straw adapter 2 are on the same axial line when the straw adapter 2 is rotated with respect to the container body 1 to a prescribed fastening position. The straw adapter 2 is mounted on the container body 1 and rotated with respect to the container body 1 until the positioning projections 1*a*, 2*a* are brought to position on the same axial line, whereby the straw adapter 2 can be brought into a prescribed fastened state, and the prescribed fastened state can be confirmed. A thread stopper (not shown) which is axially extended is provided at the end of the thread 1*c* disposed in an upper part of the outside circumferential surface of the container body 1. The fastened state may be confirmed by abutting the thread 2*c* of the straw adapter 2 on the thread stopper of the container body 1. As shown in FIG. 2, knobs 2*b* are provided, diagonally opposed to each other on the outside surface of the straw adapter 2. Fingers are caught by the knob 2*b* to thereby facilitate rotating to fasten the straw adapter 2.

A cylindrical casing 4 is projected downward from the inside of the straw adapter 2. A valve body 6 (an air hole opening/closing valve) is coaxially inserted in the valve casing 4 through a cylindrical packing 5 and is rotatable on the axial line. A communication passage 7 formed on the outside surface of the valve body 6, is axially extended. A lock member 9 having a nip 8 is disposed, in one-piece, on the top of the valve body 6. Air holes 10, 5*a* are formed through sides of the valve casing 4 and the packing 5. The valve body 6 is rotated by the nip 8 via the lock member 9, whereby the air hole 10 is opened and closed to bring the inside of the container body 1 into and out of communication with the outside atmosphere through the air holes 10, 5*a* and the communication passage 7.

Figure 5:
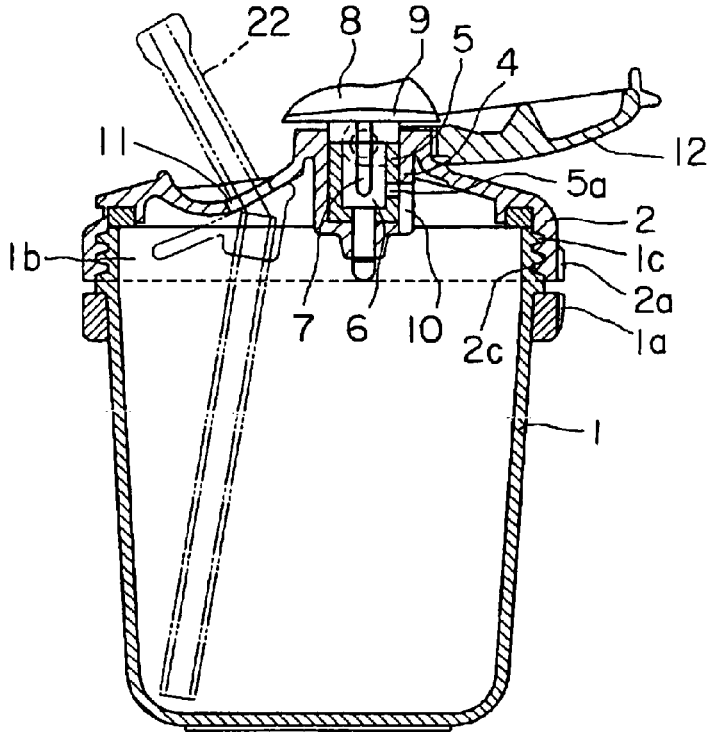
FIG. 5 is the beverage container with a straw according to the present invention in the state where the straw cap is opened.
Figure 6:
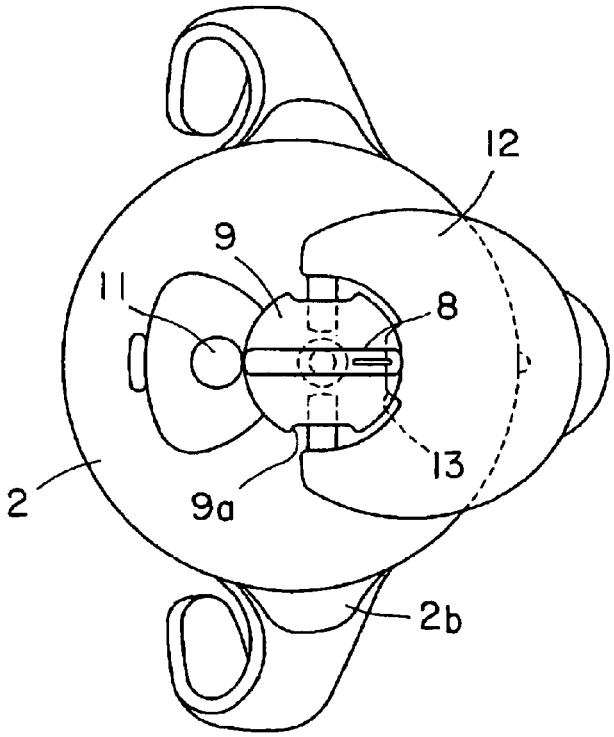
FIG. 6 is a plan view of the beverage container with a straw shown in FIG. 5.

The straw adapter 2 has a straw hole 11 eccentrically formed therethrough with respct to the center. A straw 22 (see FIG. 5) is retained inserted in the straw hole 11. A straw cap 12 is disposed on the straw adapter 2 swingably through a pin which is normal to the axial line of the valve body 6. The straw cap 12 can cover, in its closed position, the straw 22 inserted in the straw hole 11.

A semi-circular recess 12*a* having a slightly larger diameter than a diameter of the lock member 9 is formed in one part of the straw cap 12 on the side of the swing pin. A lock piece 13 is projected at the middle portion of the semi-circular recess 12*a*. Recesses 9*a* through which the lock piece 13 can pass are formed in the lock member 9 at positions opposed to each other. When the valve body 6 is rotated to the open position, the recess 9*a* is brought to a position corresponding to the lock piece 13 of the straw cap 12.

Normally, however, as shown in FIGS. 1 and 2, when the valve body 6 and the straw cap 12 are in their closed states, the circumferential edge of the lock member 9 is positioned above the lock piece 13 of the straw cap 12, which prohibits the straw cap 12 from swinging in the opening direction, locking the straw cap 12.

Figure 3:
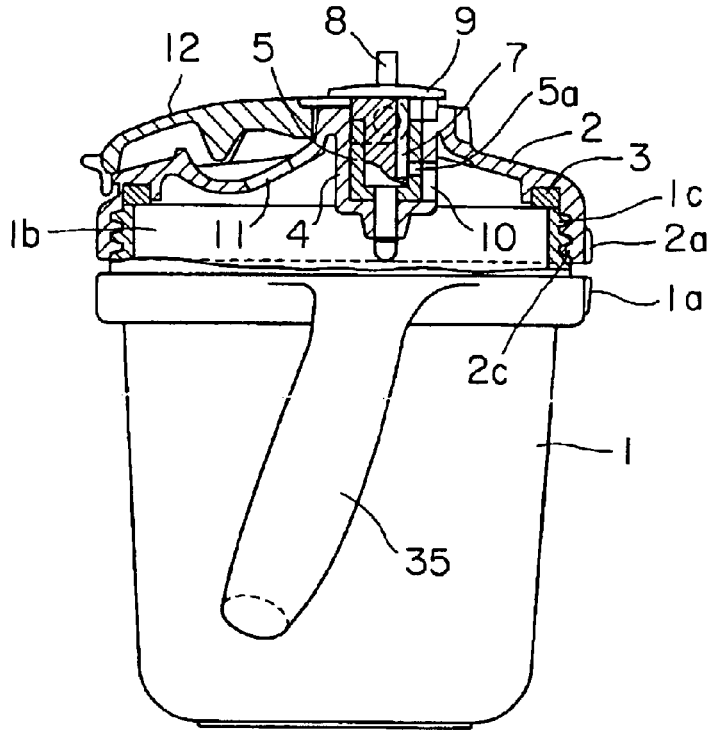
FIG. 3 is a view of the beverage container with a straw according to the present invention in the state where the straw cap is unlocked.
Figure 4:
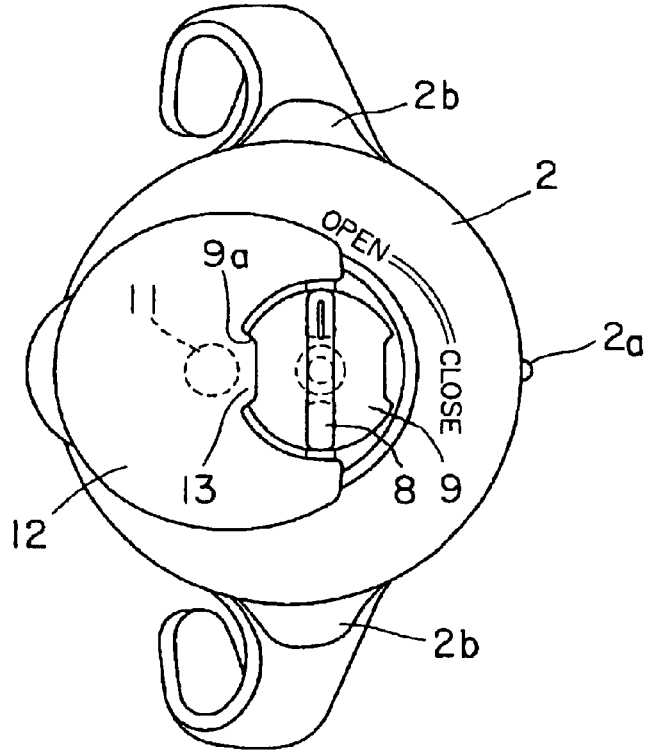
FIG. 4 is a plan view of the beverage container with a straw shown in FIG. 3.

Then, when a beverage held in the beverage container is drunk, as shown in FIGS. 3 and 4, the nip 8 is rotated to the opening position, rotating the valve body 6 by 90°, and the air holes 10, 5*a* are opened through the communication passage 7 to release a pressure inside the container to the outside atmosphere. At this time, as shown in FIG. 4, by the rotation of the lock member 9, the recess 9*a* of the lock member 9 is positioned above the lock piece 13 to release the lock of the straw cap 12. Thus, the straw cap 12 is allowed to swing in the opening direction as shown in FIGS.

5 and 6. Then, the straw cap 12 is opened, and the straw 22 comes outside as indicated in the two-dot chain line in FIG. 5. Then, when the straw cap 12 is swung to the opposite side, and the lock member 9 is returned to the closing position, the circumferential edge of the lock member 9 is engaged with the upper part of the lock piece 13 of the straw cap 12, and the straw cap 12 is locked. Thus, with the straw cap 12 locked, a beverage held in the container body 1 can be drunk with the straw 22.

When the beverage has been drunk, the lock member 9 is rotated to the opening position to release the lock of the straw cap 12, and then the straw cap 12 is returned back to the original position. Thus, the straw cap 12 is locked by the lock member 9.

As described above, in the beverage container with a straw, the lock member 9 for opening the straw cap 12 is rotated to thereby automatically open the air hole opening/closing valve. Thus, no intentional operation for the pressure release is required, which can prevent erroneous operations, such as forgetting the pressure release.

Figure 7:
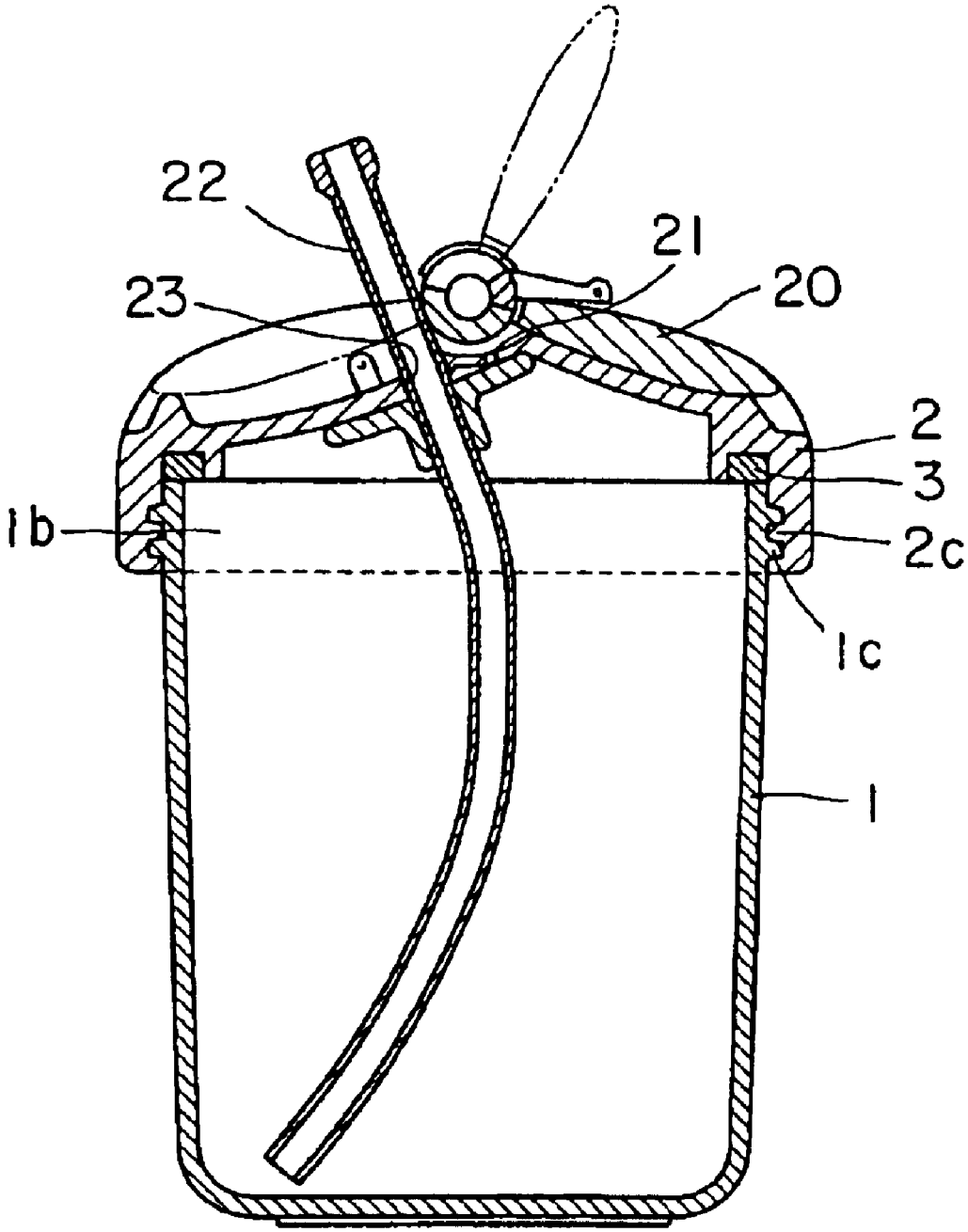
FIG. 7 is a vertical sectional side view of the beverage container with a straw according to another embodiment of the present invention.

FIG. 7 is a view of the beverage container with a straw according to a second embodiment of the present invention. A straw cap 20 is swingably mounted on a straw adapter 2 provided on the upper end portion of a container body 1. The straw adapter 2 includes an air hole 21 which is opened and closed by swinging the straw cap 20, and a straw insert hole 23 in which a straw 22 is inserted, is formed in the straw adapter 2.

Figure 8:
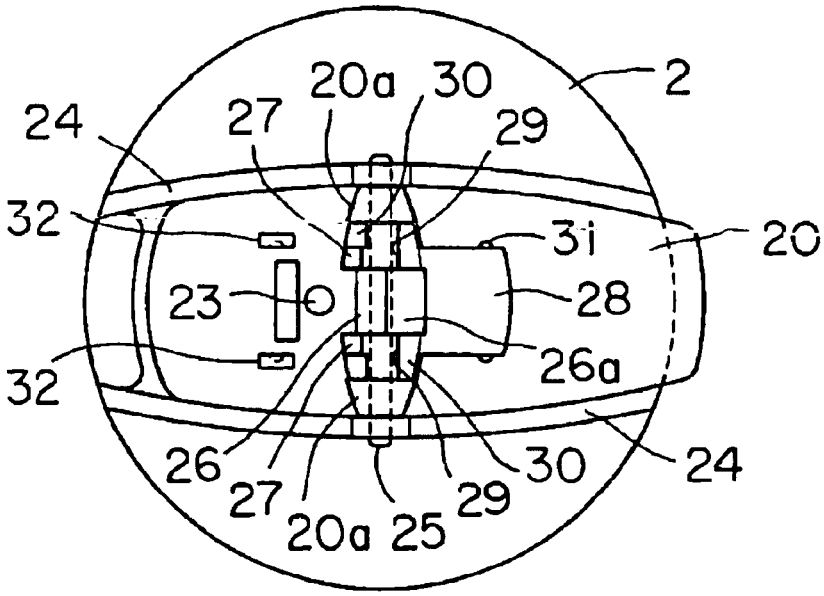
FIG. 8 is a plan view of the beverage container with a straw shown in FIG. 7 in the state where the straw cap is opened.
Figure 9:
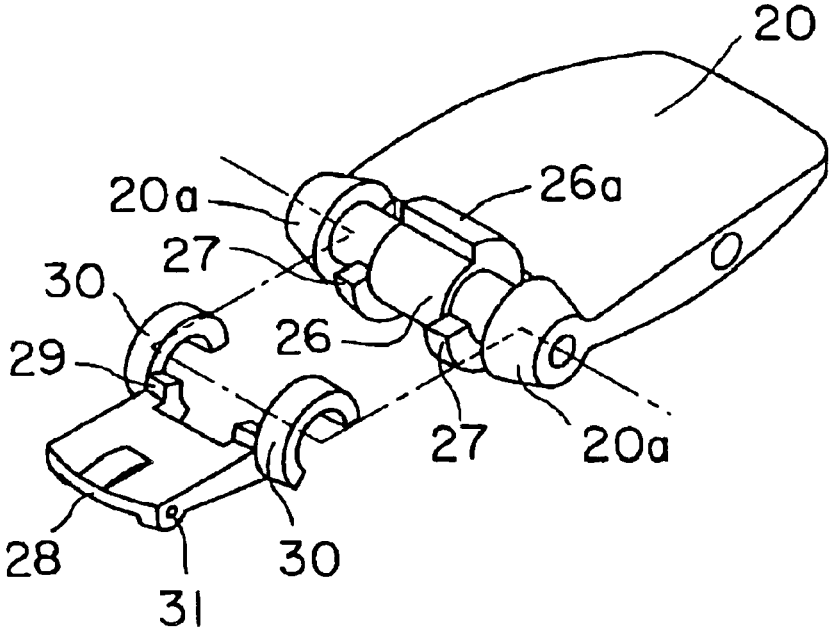
FIG. 9 is a broken perspective view of the straw cap.

FIG. 8 is a plan view of the straw cap 20 of the beverage container with a straw in its opened state (the straw is not shown). A couple of raised ribs 24 are extended substantially parallel with each other on the upper surface of the straw adapter 2. A pin 25 to which the straw cap 20 is fixed, is held between the ribs 24. As shown in FIG. 9, bosses 20*a* are provided respectively on both sides of the proximal end of the straw cap 20. The pin 25 is inserted in the bosses 20*a*, 20*a*. The air hole opening/closing valve 26 for opening and closing the air hole 21 is secured to the straw cap 20 at the intermediate portion between the bosses 20*a*, 20*a*. The air hole opening/closing valve 26 is formed of an elastic material and has a larger-diameter portion 26*a* along a prescribed portion of the outer circumferential edge. The straw cap 20 has drive projections 27 which are extended along the circumference of the pin 25 on both sides of the air hole opening/closing valve 26 and are to be positioned below the pin 25 when the straw cap 10 is swung in the opening direction.

A straw pusher 28 which is positioned inside the straw cap 20, is swingably mounted on the pin 25. Lock pieces 29 are provided on the proximal end of the straw pusher 28. When the straw cap 20 is swung in the opening direction, the lock pieces 29 are engaged with the drive projections 27 to swing the straw pusher 28 in the opening direction. Bearings 30 for the pin are provided on the outer sides of the respective lock pieces 29.

Holding portions 32 are projected on the upper surface of the straw adapter 2. When the straw pusher 28 is in its original position, the holding portions 32 are in engagement with a small projections 31 provided on both sides of the straw pusher 28 to thereby retain the straw pusher 28.

Figure 10A:
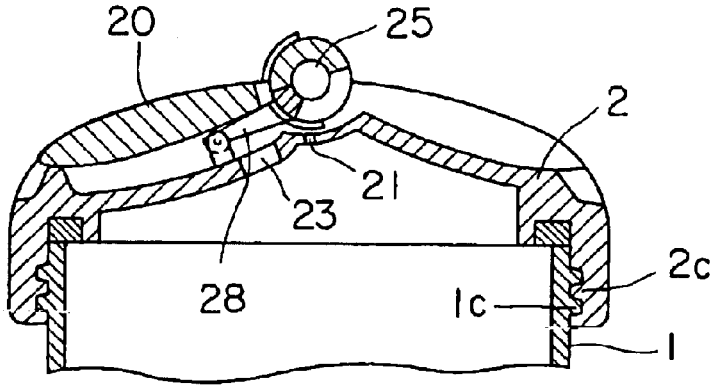
FIGS. 10A to 10C are views explaining an operation of the beverage container with a straw shown in FIG. 7.
Figure 10B:
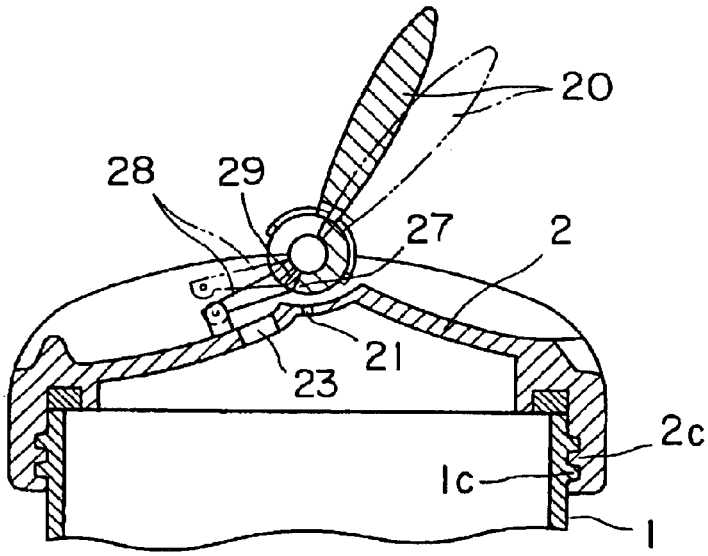
Figure 10C:
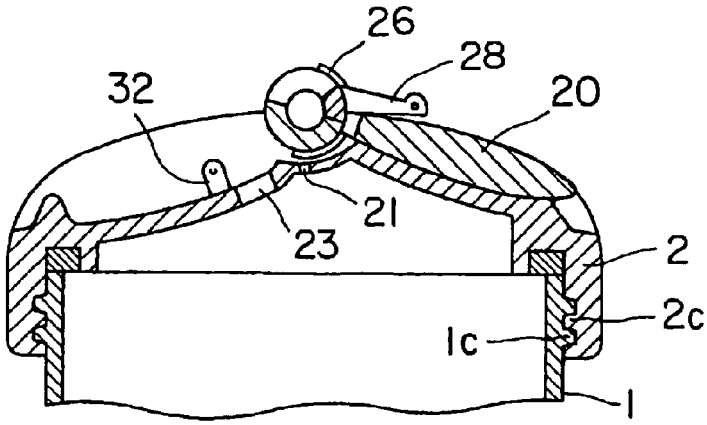

Thus, when the beverage container holds a beverage, the straw cap 20 is in the position where the straw cap 20 covers the straw hole 23, and the larger-diameter portion 26*a* of the air hole opening/closing valve 26 closes the air hole 21 (FIG. 10A). Then, the straw cap 20 is swung in the opening direction, the air hole opening/closing valve 26 swings to opening the air hole 21, and the pressure inside the container is released to the outside atmosphere (FIG. 10B). Then, the straw cap 20 is further swung in the opening direction, and the drive projections 27 on the straw cap 20 are brought into abutment on the locking pieces 29 of the straw pusher 28. Then the straw pusher 28 is swung in the opening direction (FIG. 10C), and the straw 22 (see FIG. 7) comes out. After that, the straw cap 20 is completely swung in the opening direction to be secured to the straw adapter 2, whereby the air hole 21 is closed by the large-diameter portion 26 of the air hole opening/closing valve 26, and the beverage in the container body 1 can be drunk.

Thus, in the present embodiment as well, no intentional pressure release is required, and by operating the straw cap 20 the air hole can be automatically opened. Erroneous operations, such as forgetting the pressure release, can be prevented.

As shown in FIG. 1, lower portion of the handles 35 provided on the sides of the container body 1 may be tilted to be positioned on the side of the straw hole for the straw 22. This arrangement of the handles 35 permits the straw 22 to be slanted only by simply holding the handles straight. As a result, an infant can smoothly drink without turning the wrists.

As described above, the straw adapter has the straw cap for covering the straw inserted in the straw adapter, and the air hole opening/closing valve is opened by opening the straw cap. Due to the opening operation of the straw cap, the air hole can be automatically opened, and the pressure inside the container is released. Accordingly, no intentional pressure release is required, whereby erroneous operations, such as forgetting the pressure release, etc., can be prevented.

Figure 11:
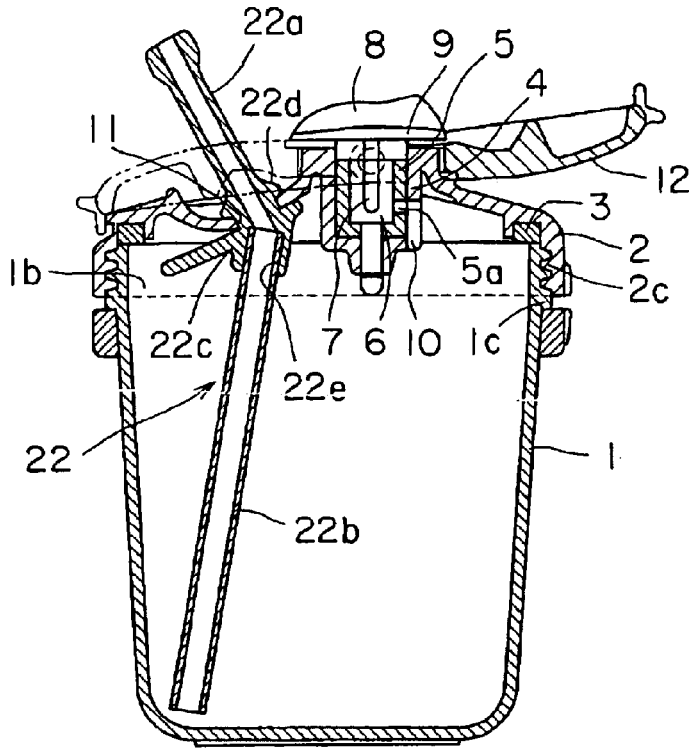
FIG. 11 is a vertical sectional view of the beverage container with a straw according to a second embodiment of the present invention.
Figure 12:
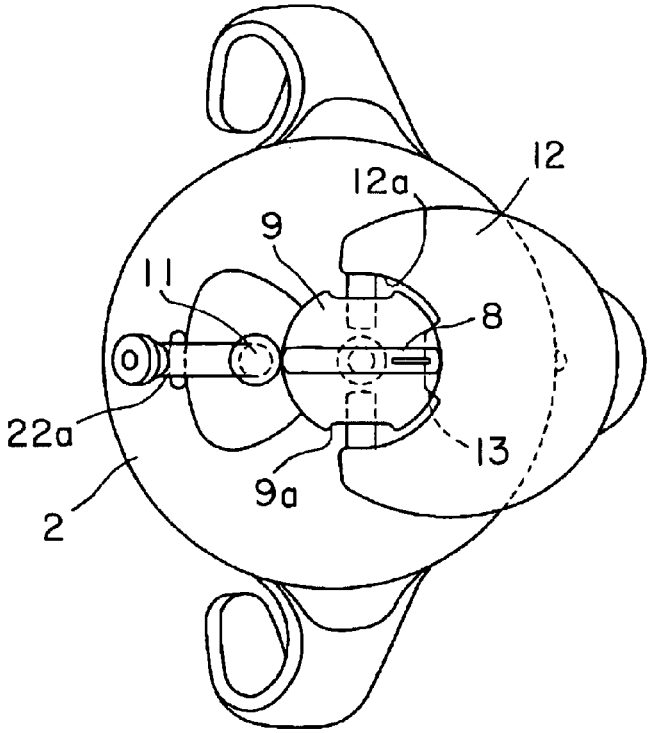
FIG. 12 is a plan view of the beverage container with a straw shown in FIG. 1.

FIG. 11 is a partial sectional side view of the beverage container with a straw according to another embodiment of the present invention. FIG. 12 is a plan view of the beverage container with a straw shown in FIG. 11. As shown in FIG. 11, the beverage container with a straw comprises a container body 1 having an opening 1*b*, and a straw adapter 2 thread-engaged with the opening 1*b* of the container body 1. A packing 3 is disposed circumferentially inside the straw adapter 2 for making a seal between the straw adapter 2 mounted on the container body 1 and the upper end of the container body 1.

A cylindrical casing 4 is projected downward from the inside of the straw adapter 2. A valve body 6 (an air hole opening/closing valve) is coaxially inserted in the valve casing 4 through a cylindrical packing 5 and is rotatable on the axial line. A communication passage 7 formed on the outside surface of the valve body 6, is axially extended. A lock member 9 having a nip 8 is disposed, in one-piece, on the top of the valve body 6. Air holes 10, 5*a* are formed through sides of the valve casing 4 and the packing 5. The valve body 6 is rotated by the nip 8 via the lock member 9, whereby the air hole 10 is opened and closed to bring the inside of the container body 1 into and out of communication with the outside atmosphere through the air holes 10, 5*a* and the communication passage 7.

The straw adapter 2 has a straw hole 11 eccentrically formed therethrough with respect to the center. A straw 22 (see FIG. 5) is retained inserted in the straw hole 11. A straw cap 12 is disposed on the straw adapter 2 swingably through a pin which is normal to the axial line of the valve body 6. The straw cap 12 can cover, in its closed position, the straw 22 inserted in the straw hole 11.

A semi-circular recess 12*a* having a slightly larger diameter than a diameter of the lock member 9 is formed in one part of the straw cap 12 on the side of the swing pin. A lock piece 13 is projected at the middle portion of the semi-circular recess 12*a*. Recesses 9*a* through which the lock piece 13 can pass, are formed in the lock member 9 at positioned opposed to each other. When the valve body 6 is rotated to the open position, the recess 9*a* is brought to a position corresponding to the lock piece 13 of the straw cap 12.

The straw 20 comprises a shorter straw component 22*a* and a longer straw component 22*b*. The longer straw component 22*b* is connectable to the shorter straw component 22*a*. At the proximal end of the shorter straw component component 22*a*, a larger-diameter collar 22*c* is disposed inside the container body, and a smaller diameter-flange 22*d* is disposed outside the container body. The inner circumferential edge of the straw hole 11 of the straw adapter 2 is held between the collar 22*c* and the flange 22*d*, and the shorter straw component 22*a* is secured to the straw adapter 2. A straw insert hole 22*e* which is tilted by a prescribed angle with respect to the axial line of the shorter straw component 22*a* is disposed in the collar 22*c*, and the longer straw 22*b* is inserted in the straw insert hole 22*c*.

The straw cap 12 is normally in the closed state indicated by the one-dot chain line in FIG. 11, and the circumferential edge of the lock member 9 is positioned above the lock piece 13 of the straw cap 12, whereby the straw cap is prohibited from swinging in the opening direction.

Then, when a beverage held in the beverage container is drunk, the nip 8 is rotated to the opening position, rotating the valve body 6 by 90°. In this case, the air holes 10, 5*a* are opened through the communication passage 7 to release a pressure inside the container to the outside atmosphere. At this time, by rotating lock member 9 the recess 9*a* of the lock member 9 is positioned above the lock piece 13, releasing the lock of the straw cap 12. Thus, the straw cap 12 is allowed to swing in the opening direction as shown in FIG. 11. Then, when the straw cap is thus opened, the shorter straw component 22*a* of the straw rises from the surface of the straw adapter 2. The straw cap is thus completely released and the lock member 19 is returned to the closing position, whereby the circumferential edge of the lock member 9 is brought into engagement with the upper part of the lock piece 13 of the straw cap 12, and the straw cap 12 is locked. After locking the straw cap 12, a beverage in the container can be drunk with the shorter straw 22*a* projected through the straw adapter 2.

When the beverage has been drunk, the lock member 9 is rotated to the opening position to release the lock of the straw cap 12. Then the straw cap 12 is returned back to the original position, and the lock is made by the lock member 9 is locked.

As described above, in the beverage container with a straw, the lock member 9 for opening the straw cap 12 is rotated to thereby automatically open the air hole opening/closing valve. Thus, no intentional operation for the pressure release is required, which can prevent erroneous operations, such as forgetting the pressure release.

Furthermore, the straw 22 is divided into the shorter straw component 22*a* and the longer straw component 22*b*, and the shorter straw component 22*a* is secured to the straw adapter 2. Even when an infant pulls the straw 22, the straw 22 never comes off, nor a length of the straw 22 projected outside from the straw adapter 2 is never changed.

As described above, the straw 22 is divided into the two components, i.e., longer and shorter straw components. First, the shorter straw component 22*a* alone is used in accordance with the growth of infants, whereby an infant can drink beverages from the container tilted, as from nipples and spouts they have used. When an infant become able to understand that a beverage come out through the straw component 22, the longer straw component 22*b* is attached for use, whereby the infant can grow to use the straw 22 in place of nipples and spouts. An angle is formed between the shorter straw component 22*a* and the longer straw component 22*b*, which allows the lower end of the longer straw component 22*b* to be positioned at a corner of the container body 1, whereby the beverage can be completely discharged.

As described above, in the present invention, the straw comprises the longer straw component and the shorter straw component which are connectable to each other, and the component is secured to the straw adapter, whereby even when an infant pull the straw, the straw never comes out. A length of the straw projected from the straw adapter is never changed, and the straw is retained always in a length which facilitates the drinking, whereby the whole of the beverage can be smoothly discharged and drunk.

What is claimed is:

1. A beverage container comprising:

a container body having an opening;

a straw adapter engaged with the opening of the container body and for holding a straw in a straw hole;

a straw cap being disposed on the straw adapter for covering the straw hole, wherein the straw adapter further includes the straw operatively engaged with said straw hole, an air hole, an air hole opening and closing valve being disposed on a distal end of the straw cap so as to cooperate with the straw cap for opening and closing the air hole, and a rotatable locking member being provided on the straw adapter for retaining the straw cap in an opened state or a closed state and said air hole in an opened state or a closed state, wherein the air hole opening and closing valve is operatively secured to the locking member, wherein said locking member has an opened position and a closed position, and said straw cap may be positioned in said opened state while said locking member is simultaneously positioned in either of said opened position or said closed position of said locking member.

2. The beverage container according to claim 1, wherein the straw adapter further includes a cylindrical valve casing, wherein the air hole is formed in the valve casing, and the air hole opening and closing valve comprises a valve body rotatably disposed in the valve casing.

3. The beverage container according to claim 2, wherein a communication passage is provided on an outside surface of the valve body for communicating the air hole with the atmosphere.

4. The beverage container according to claim 2, wherein the valve body in the valve casing is rotated by the locking member.

5. The beverage container according to claim 1, wherein the straw adapter is thread-engaged in the container body; and positioning projections are provided respectively on the outside surfaces of the straw adapter and the container body, for indicating that the straw adapter is at a prescribed fastening position with respect to the container body.

6. The beverage container according to claim 1, wherein knobs are provided on the outside surface of the straw adapter.

7. The beverage container according to claim 1, wherein handles are provided on the outside surface of the container body, and the handles extend toward the straw.

8. The beverage container according to claim 1, wherein the straw includes a longer straw component positioned inside the container body and a shorter straw component positioned outside the container body, which can be interconnected with each other, and the shorter straw component is secured to the straw adapter.

9. A beverage container comprising:

a container body having an opening;

a straw adapter engaged with the opening of the container body and for holding a straw in a straw hole, wherein the straw includes a longer straw component positioned inside the container body and a shorter straw component positioned outside the container body, which can be interconnected with each other, and the shorter straw component is secured to the straw adapter;

a straw cap being disposed on the straw adapter for covering the straw hole, wherein the straw adapter further includes the straw operatively engaged with said straw hole, an air hole, an air hole opening and closing valve being disposed on a distal end of the straw cap so as to cooperate with the straw cap for opening and closing the air hole, and a rotatable locking member being provided on the straw adapter for retaining the straw cap in an opened state or a closed state and said air hole in an opened state or a closed state, wherein the air hole opening and closing valve is operatively secured to the locking member, wherein the shorter straw component has one end engaged in a straw hole of the straw adapter, and the distal end of the shorter straw component has an outer flange and an inside collar for securing the shorter straw component to the straw adapter.

10. The beverage container according to claim 9, wherein a straw insert hole tilted to the axis of the shorter straw component is provided at the collar, and the longer straw component is inserted into the straw insert hole.

* * * * *